US007413489B1

(12) United States Patent
LaSalvia et al.

(10) Patent No.: US 7,413,489 B1
(45) Date of Patent: Aug. 19, 2008

(54) COPPER TO ALUMINUM BIMETALLIC TERMINATION

(75) Inventors: Jose Alexandre LaSalvia, Sao Jose Dos Campos (BR); Vagner Fuzetti, Braganca Paulista (BR)

(73) Assignee: Tyco Electronics Brasil Ltda., Sao Paulo (BR)

( * ) Notice: Subject to any disclaimer, the term of this patent is extended or adjusted under 35 U.S.C. 154(b) by 0 days.

(21) Appl. No.: 11/766,159

(22) Filed: Jun. 21, 2007

(51) Int. Cl.
*H01R 4/10* (2006.01)

(52) U.S. Cl. ..... 439/877; 439/887; 29/861

(58) Field of Classification Search ..... 439/877–882, 439/886, 887; 29/861–863, 871
See application file for complete search history.

(56) References Cited

U.S. PATENT DOCUMENTS 4,039,244 A * 8/1977 Leachy ..... 439/887
5,882,233 A * 3/1999 Idehara ..... 439/877
6,641,444 B2 * 11/2003 Hanazaki et al. ..... 439/877
6,884,127 B2 * 4/2005 Quillet et al. ..... 439/877
6,976,889 B2 * 12/2005 Kuwayama et al. ..... 439/877
7,198,526 B1 * 4/2007 MacNeil et al. ..... 439/881
7,306,495 B2 * 12/2007 Hashimoto et al. ..... 439/877

* cited by examiner

*Primary Examiner*—Khiem Nguyen

(57) ABSTRACT

The connector includes an annular connector body that is substantially comprised of copper, and an annular insert portion made of brass and clad with tin. Apertures are made through the wall of the insert portion. The insert portion is configured to have an exterior frictionally fit within the connector body. Inserting a stranded aluminum cable into the annular insert portion and crimping the connector body, the insert portion and the cable, causes the outer strands of the stranded aluminum cable to be extruded through the plurality of apertures, removing oxide film on the exterior surface of the aluminum cable and forming a sealed electrical connection between the aluminum cable and the copper connector body.

18 Claims, 3 Drawing Sheets

COPPER TO ALUMINUM BIMETALLIC TERMINATION

FIELD OF THE INVENTION

The present invention is directed to an electrical connector, and more specifically to an electrical connector that includes a copper body and a tin-clad liner insert to facilitate electrical connections between copper and aluminum circuit elements.

BACKGROUND OF THE INVENTION

Major problems are related to oxide film existent on aluminum wire surfaces, which are difficult to break and to establish a good electrical connection and the galvanic corrosion process while both aluminum and copper conductors are in contact.

Electrical power distribution systems frequently include a mixture of aluminum and copper conductors at various portions of the distribution system. When used in contact with one another, aluminum and copper conductors, a corrosion process erodes the aluminum cable. This corrosion is typically caused where the copper and aluminum interface is exposed to the outdoor environment, or to other corrosive environment.

Copper cables have greater current capacity and are easier to connect, since its oxide layer surface is easily broken. Aluminum cables are lighter and cheaper, while its current capacity is about just 60% of the equivalent copper cable size. Typical power networks are assembled using aluminum cables for low voltage distribution and copper cables to feed residential and commercial customers. Copper cables are commonly used for residential and commercial customers since the metering equipment electrical contacts are normally made from copper alloys. In order to avoid corrosion problems with the power meter connectors, copper cables are preferred, notwithstanding its higher cost.

Conversely, aluminum conductors have an undesirable characteristic of forming a high resistance film of aluminum oxide on the outside of the conductor when it is exposed to the air. Aluminum oxide is a fast forming, hard, non-conductive coating that develops on the surface of aluminum conductors exposed to air. Unlike copper oxides, aluminum oxide is not visually obvious and should be assumed to exist in all cases of bare aluminum. To prevent high-resistance connections, which can be fire hazards, it is necessary to remove from a conductor's surface prior to making a connection. Wire brushing and the immediate application of an oxide inhibitor are recommended to prevent the reformation of the non-conductive coating prior to connector installation. An alternate method that is used to achieve low contact resistance is for the connection methodology to physically break through the aluminum oxide layer as the connection is being made. Even with these types of connections, however, cleaning the conductor is still recommended prior to installation.

The typical solution for oxidation is conductor preparation by cleaning its surface. However, after the oxide is cleaned, by scraping or wire-brushing the conductor, the oxidation reforms quickly. Unless the connection is properly prepared, a high resistance contact is the result and heating is likely to occur.

An oxidation inhibitor compound, e.g., grease, is frequently applied to the conductor after the connection is made, to provide an oxygen barrier for the connection, to avoid new oxide layer formation.

In addition, aluminum also suffers from other forms of corrosion, e.g., creep corrosion.

What is needed is a system and/or method that satisfies one or more of these needs or provides other advantageous features. Other features and advantages will be made apparent from the present specification. The teachings disclosed extend to those embodiments that fall within the scope of the claims, regardless of whether they accomplish one or more of the aforementioned needs.

SUMMARY OF THE INVENTION

In one embodiment, the invention is directed to a connector. The connector includes an annular connector body that is substantially comprised of copper material, and an annular insert portion substantially made of brass and clad with tin. Apertures are made through the wall of the insert portion. The insert portion is disposed substantially coaxially with the connector body. The insert portion is configured to have an exterior frictionally fit within the connector body. Inserting a stranded aluminum cable into the annular insert portion and simultaneously crimping the connector body, the insert portion and the cable, causes at least some of the strands of the stranded aluminum cable to be extruded through the plurality of apertures, wherein an oxide film on an exterior surface of the aluminum cable is removed and a sealed electrical connection is formed between the aluminum cable and the copper connector body.

In another embodiment, the invention is directed to an electrical termination that includes a copper bus bar, at least one aluminum cable; and a connector portion. The connector portion includes an annular connector body that is substantially comprised of copper material, and an annular insert portion substantially made of brass and clad with tin. Apertures are made through the wall of the insert portion. The insert portion is disposed substantially coaxially with the connector body. The insert portion is configured to have an exterior frictionally fit within the connector body. Inserting a stranded aluminum cable into the annular insert portion and simultaneously crimping the connector body, the insert portion and the cable, causes at least some of the strands of the stranded aluminum cable to be extruded through the plurality of apertures, wherein an oxide film on an exterior surface of the aluminum cable is removed and a sealed electrical connection is formed between the aluminum cable and the copper connector body.

In another embodiment, the invention is directed to a method of reducing oxidation corrosion in a bimetallic electrical connection. The method includes the steps of providing an annular copper connector body and an annular brass insert portion; coating the connector body and the insert portion with a layer of tin; perforating a surface of the insert portion with a plurality of apertures; inserting the insert portion into the connector portion with a friction fit; inserting an aluminum cable end into the insert portion; crimping the aluminum cable end, the connector body, and the insert portion together to form a sealed electrical connection is between the aluminum cable and the copper connector body; attaching the crimped connector body to a copper electrical bus bar to form a bimetallic junction having a tin exterior layer disposed between a copper bus bar and an end of the aluminum cable when the crimped connector is attached to the copper bus bar.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

The application will become more fully understood from the following detailed description, taken in conjunction with the accompanying figures, wherein like reference numerals refer to like elements, in which.

DETAILED DESCRIPTION OF THE INVENTION

Figure 1:
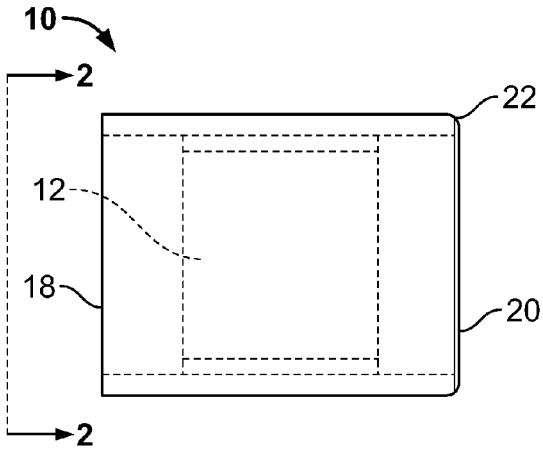
FIG. 1 is a side elevation view of a connector having broken lines representing invisible internal lines.
Figure 2:
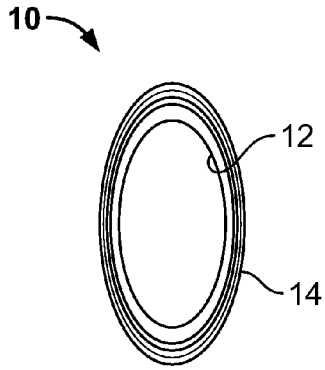
FIG. 2 is a plan view.
Figure 3:
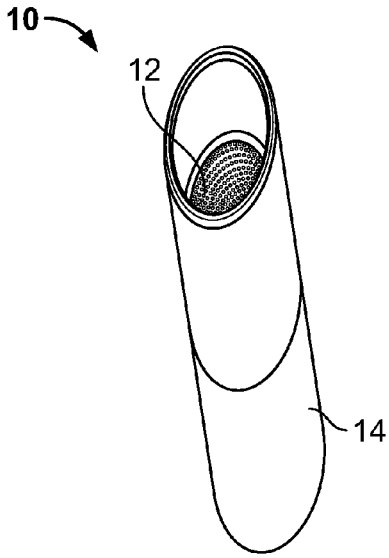
FIG. 3 is an isometric view.
Figure 4:
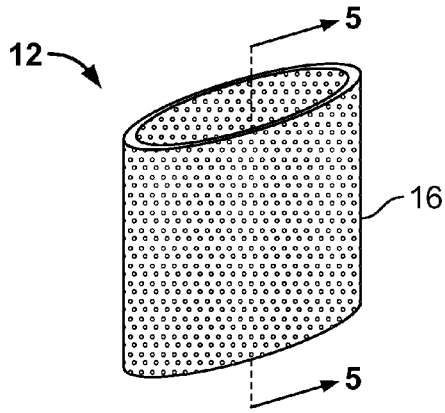
FIG. 4 is an isometric view of a micro-perforated insert.

Referring to FIGS. 1-6, a crimp-type connector 10 is made up of a hollow copper or tin-clad copper body portion 14 and a tin-clad brass insert portion 12. The insert portion 12 is perforated with micro holes 16.

The insert portion 12 fits into the inner dimension of the hollow body portion 14. The insert portion 12 is friction fit within the body portion 14 so as to remain within the interior of the body portion 14 when a multi-stranded cable end is inserted within the connector 10. In one embodiment, the insert portion 12 has length that is generally less than the length of the body portion 14. In one embodiment, the body portion 14 extends or overlaps the ends of the insert portion 12 at both ends 18, 20, to form a slightly larger inner diameter at either end. The body portion 14 may have a beveled or tapered edge 22 at either or both ends, to facilitate insertion of the termination into, e.g., a lug terminal on a power bus 24. The slightly larger inner diameter at either end 18, 20 facilitates the insertion of a stranded aluminum or copper cable 26, into the connector 10 hollow interior. The connector 10 may be circular in cross-section, or may have an elliptical or other non-circular cross-sectional profile, wherein the inner portion 12 has an exterior dimension approximately equal to or slightly less than the internal dimension of the outer body portion 14.

Figure 5:
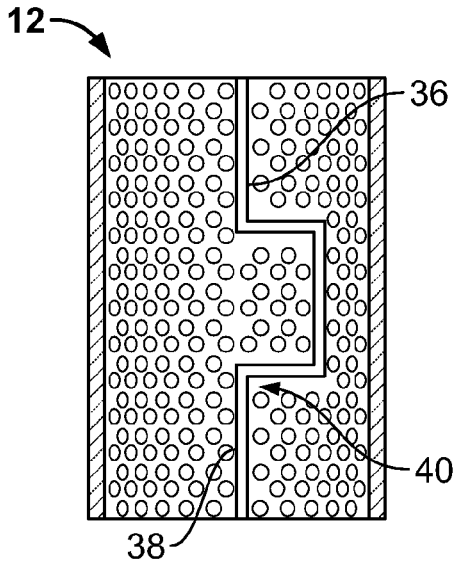
FIG. 5 is a cross-sectional elevation view of the insert.
Figure 6:
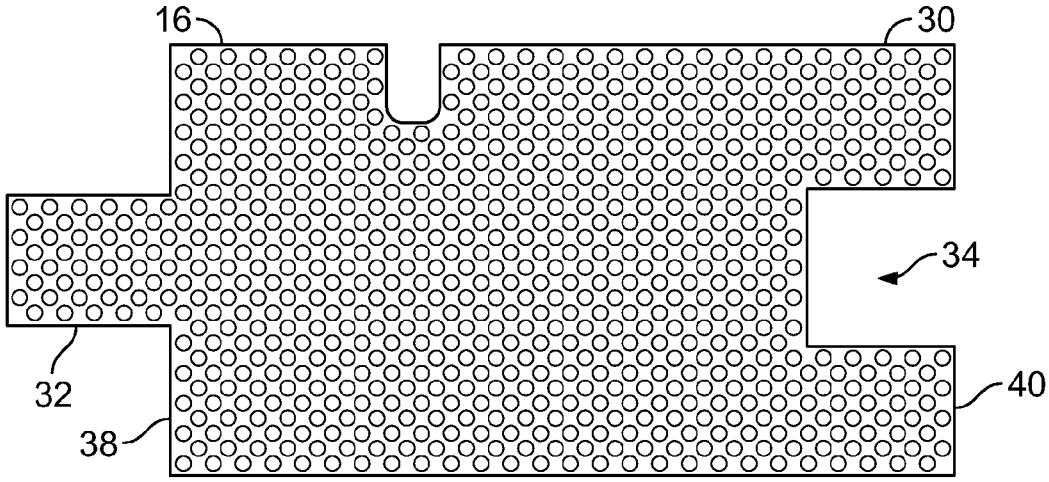
FIG. 6 is an elevational view of the flattened insert, shown before the insert is wrapped to form a cylindrical shell.

Referring next to FIGS. 5 and 6, in one embodiment the insert may be formed or cut from a flat piece of perforated metal strip 30. A tab 32 is located on one side of the strip 30, and a complementary slot 34 is located on the opposite side of the strip 30. The strip 30 is bent around 180° so that the tab 32 substantially fills the entire slot 34, creating a circular ring. The insert 12 has a seam 36 at the intersection of the edges 38, 40, after the flat strip 30 is bent around 180°. Typical hole diameter for perforations 16 may be in the range of 0.016 to 0.057 inches (0.4 to 1.4 mm), although smaller or larger diameter holes may also be used for smaller or larger inserts.

The connector 10 provides an electrical connection between all wire strands that form the cable 26 when crimping the connector 10 to an end of a cable 26. The crimped terminal 10 substantially equalizes the distribution of electrical current between the individual wire strands of the cable 26. The aluminum wires are forced extruded on the micro holes; in such manner that the oxide film on the exterior surface is removed. In addition, a sealed or gastight bimetallic connection is achieved and tin finishing is presented on the termination surface, creating a junction of the aluminum cable with the copper bar. This gastight junction prevents the corrosion process from occurring.

The disclosed crimp connector 10 provides a reliable and economical termination method for both aluminum and copper wires. A copper outer body construction with tin cladding, and a perforated copper alloy or brass insert portion is used. Alternately the outer body may be provided without the tin cladding. This construction, coupled with a crimp tool, produces electrically and mechanically stable connections by overcoming the inherent problems of aluminum oxide penetration and reformation, cold flow, creep, corrosion and thermal expansion (common in aluminum-to-copper applications).

High crimping force deformation is used to achieve electrically and mechanically reliable terminations. During crimping, the relatively soft aluminum conductor is extruded through the liner perforations, fracturing the brittle aluminum oxides and causing aluminum metal to be brought into direct contact with the liner and the wire barrel. Because of the taut configuration caused by the crimp, reforming of aluminum oxides, as well as the formation of other corrosive films, is minimized. When crimping standard conductors, this high deformation breaks up the oxides that surround each individual strand and brings the strands into direct contact with each other, creating interstrand bonds or cold welds among strands. Because of the large number of independent contact surfaces, the total contact area is increased, thus reducing the possibility of electrical failure due to thermal expansion, creep and corrosion.

Figure 7:
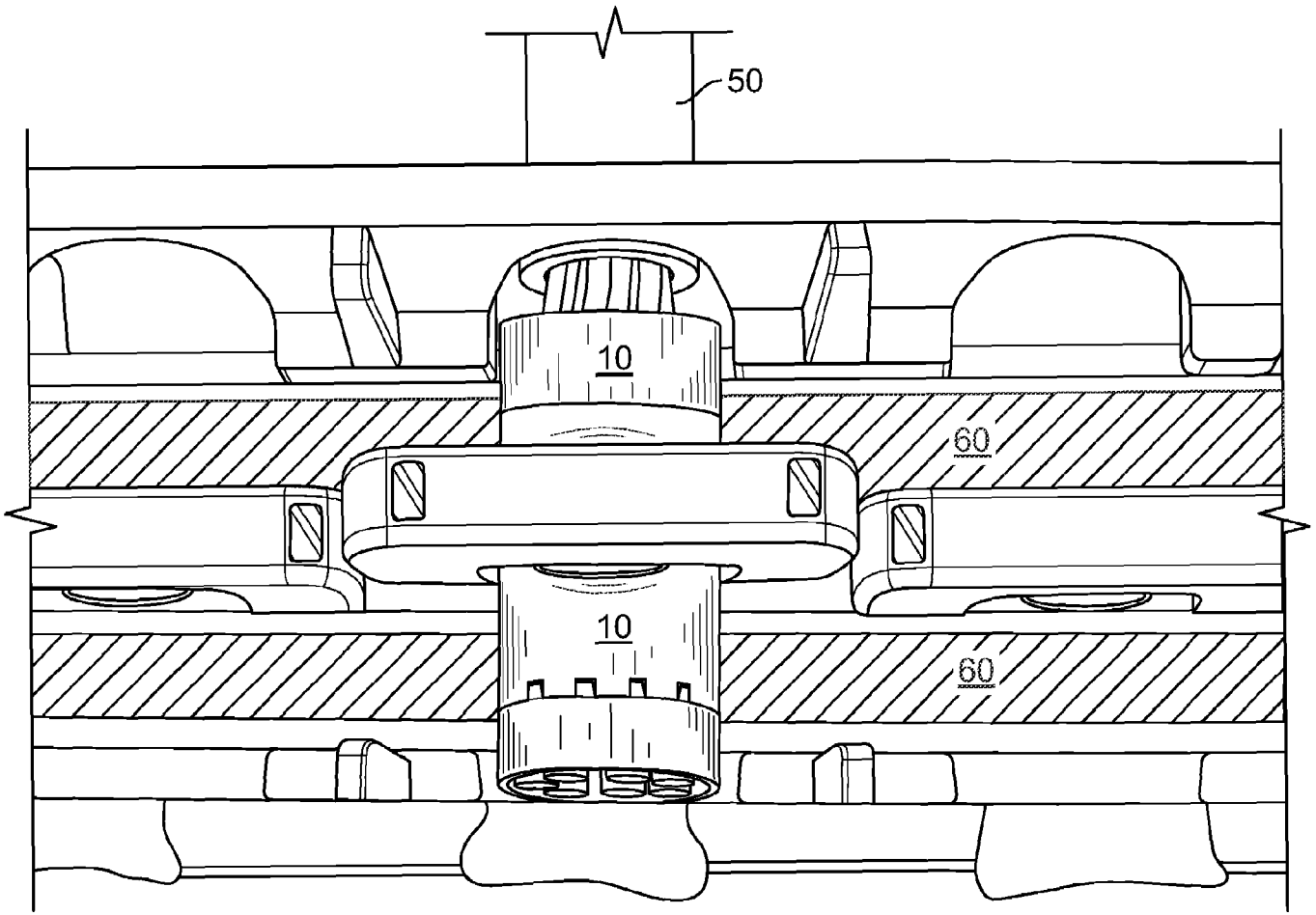
FIG. 7 is a diagram of a busbar arrangement with crimped end terminations.

Referring to FIG. 7, in one application the termination 10 is attached to one or more tinned copper busbars 60, for energy distribution, e.g., a switchboard or load center, with incoming or outgoing aluminum cables 50.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector comprising:

an annular connector body substantially comprised of copper material; and at least one annular insert portion substantially comprised of brass and clad with tin, and a plurality of apertures through a wall of the at least one insert portion, the at least one insert portion disposed substantially coaxially with the connector body;

the insert portion configured to have an exterior frictionally fit within the connector body;

wherein inserting a stranded aluminum cable into the annular insert portion and simultaneously crimping the connector body, the insert portion and the cable, causes at least some of the strands of the stranded aluminum cable to be extruded through the plurality of apertures, wherein an oxide film on an exterior surface of the aluminum cable is removed and a sealed electrical connection is formed between the aluminum cable and the copper connector body.

2. The connector of claim 1, wherein a tin exterior layer is formed on a termination interface between the aluminum cable and the connector body.

3. The connector of claim 1, wherein the crimped connector substantially equalizes the distribution of electrical current between individual wire strands of the stranded aluminum cable.

4. The connector of claim 1, wherein the connector body further comprises a layer of tin on the exterior of the copper material.

5. The connector of claim 1, wherein a bimetallic junction having a tin exterior layer is formed between a copper bus bar and an end of the aluminum cable when the crimped connector is attached to the copper bus bar.

6. The connector of claim 4 above, wherein a sealed bimetallic junction is formed between the copper busbar and the aluminum cable that prevents oxidation of the busbar and cable.

7. The connector of claim 1, wherein the insert portion having a length that is generally less than a length of the body portion.

8. The connector of claim 1, wherein the connector body overlaps at least one end of the insert portion to form a slightly larger inner annulus adjacent in at least one end of the connector.

9. The connector of claim 1, wherein the connector body includes a tapered edge on at least one end to facilitate insertion of the connector body into a terminal of an electrical bus.

10. The connector of claim 1, wherein the connector has an increased inner diameter in at least one end of the connector to facilitate insertion of the stranded aluminum cable into the annular connector body and the insert portion.

11. The connector of claim 1, wherein the connector has a circular annulus.

12. The connector of claim 1, wherein the connector has a non-circular annulus.

13. The connector of claim 1, wherein the inner portion has an external surface that is slightly less than the annulus of the connector body.

14. An electrical termination comprising:

a copper bus bar;

at least one aluminum cable; and a connector portion, the connector portion comprising:

an annular connector body substantially comprised of copper material; and at least one annular insert portion substantially comprised of brass and clad with tin, and a plurality of apertures through a wall of the at least one insert portion, the at least one insert portion disposed substantially coaxially with the connector body;

the insert portion configured to have an exterior frictionally fit within the connector body;

wherein inserting the aluminum cable into the annular insert portion and simultaneously crimping the connector body, the insert portion and the cable, causes at least a portion of the cable to be extruded through the plurality of apertures, wherein an oxide film on an exterior surface of the cable is removed and a sealed electrical connection is formed between the aluminum cable and the copper connector body.

15. The electrical termination of claim 14, wherein a tin exterior layer is formed on a termination interface between the aluminum cable and the connector body.

16. The electrical termination of claim 14, wherein the crimped connector substantially equalizes the distribution of electrical current between individual wire strands of the stranded aluminum cable.

17. The electrical termination of claim 14, wherein the connector body further comprises a layer of tin on the exterior of the copper material.

18. A method of reducing oxidation corrosion in a bimetallic electrical connection comprising:

providing an annular copper connector body and an annular brass insert portion;

coating the connector body and the insert portion with a layer of tin;

perforating a surface of the insert portion with a plurality of apertures;

inserting the insert portion into the connector portion with a friction fit;

inserting an aluminum cable end into the insert portion;

crimping the aluminum cable end, the connector body, and the insert portion together to form a sealed electrical connection is between the aluminum cable and the copper connector body;

attaching the crimped connector body to a copper electrical bus bar to form a bimetallic junction having a tin exterior layer disposed between a copper bus bar and an end of the aluminum cable when the crimped connector is attached to the copper bus bar.

* * * * *